US007357061B2

(12) United States Patent
Yael et al.

(10) Patent No.: US 7,357,061 B2
(45) Date of Patent: Apr. 15, 2008

(54) NON-EXPLOSIVE ENERGETIC MATERIAL AND A REACTIVE ARMOR ELEMENT USING SAME

(75) Inventors: Cohen-Arazi Yael, Kfar Vradim (IL); Edith Sokol-Barak, Naharia (IL); Samuel Friling, Kfar Vradim (IL); Menashe Tzalik, Kiryat Ata (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 0 days.

(21) Appl. No.: 11/488,080

(22) Filed: Jul. 18, 2006

(65) Prior Publication Data

US 2006/0254413 A1 Nov. 16, 2006

Related U.S. Application Data

(62) Division of application No. 11/105,354, filed on Apr. 14, 2005.

(30) Foreign Application Priority Data

Apr. 22, 2004 (IL) ..... 161586

(51) Int. Cl.
*F41H 5/02* (2006.01)

(52) U.S. Cl. ..... 89/36.02; 89/36.01

(58) Field of Classification Search ..... 89/36.17, 89/36.02, 36.08

See application file for complete search history.

(56) References Cited

U.S. PATENT DOCUMENTS 3,252,843 A 5/1966 Griffith et al.
3,346,219 A * 10/1967 Salyer et al. ..... 244/114 R
3,964,256 A 6/1976 Plantif et al.
4,824,495 A * 4/1989 Verneker ..... 149/7
4,881,448 A 11/1989 Medin et al.
5,293,806 A 3/1994 Gonzalez
5,439,627 A 8/1995 De Jager ..... 264/129
5,505,799 A * 4/1996 Makowiecki ..... 149/15

(Continued)

FOREIGN PATENT DOCUMENTS

DE 28 31 415 C1 7/1996

(Continued)

OTHER PUBLICATIONS

H.N. Presles, "Influence of glass microballoons size on the detonation of nitromethane based mixtures", Paper from the Laboratore d'Energetique et de Detonique, URA 193 CNRS, ENSMA, F-86034 Poitiers, France dated 1995 □□.*

(Continued)

*Primary Examiner*—Michael J. Carone
*Assistant Examiner*—Benjamin P Lee
(74) *Attorney, Agent, or Firm*—The Nath Law Group; Jerald L. Meyer; Johnathan A. Kidney

(57) ABSTRACT

The present invention provides elements for making a protective reactive armor to be fitted on the outside of an enclosure liable to be exposed to attack by shaped-charge warheads and other threats, such as kinetic energy projectiles and fragments, to thereby enhance survivability of the enclosure and its contents. The invention further provides a non-explosive energetic material useful for such reactive armor elements.

14 Claims, 1 Drawing Sheet

U.S. PATENT DOCUMENTS

| | | | | |
|---|---|---|---|---|
| 5,606,146 | A | 2/1997 | Danen et al. | 149/15 |
| 6,474,213 | B1 | 11/2002 | Walker et al. | |
| 6,484,617 | B1 * | 11/2002 | Anderson et al. | 86/50 |
| 6,619,181 | B1 | 9/2003 | Frey et al. | |
| 6,880,445 | B2 * | 4/2005 | Benyami et al. | 89/36.17 |
| 6,899,009 | B2 | 5/2005 | Christiansen et al. | 89/36.02 |
| 2002/0079680 | A1 * | 6/2002 | Moquin et al. | 280/736 |
| 2004/0118271 | A1 * | 6/2004 | Puckett et al. | 89/36.02 |

FOREIGN PATENT DOCUMENTS

| | | |
|---|---|---|
| DE | 31 32 007 C1 | 10/1999 |
| DE | 31 32 008 C1 | 10/1999 |
| EP | 0 625 495 A1 | 11/1994 |
| FR | 2 065 785 | 8/1971 |
| GB | 1061390 | 3/1967 |

OTHER PUBLICATIONS

H. N. Presles, "Influence of glass microballons size on the detonation of nitromethane based mixtures", Paper from the Laboratore d'Energetique et de Detonique, URA 193 CNRS, ENSMA, F-86034 Poiters, France dated 1995.

Wikipedia com description of Haber Process The revision is as of Dec. 17, 2003.

* cited by examiner

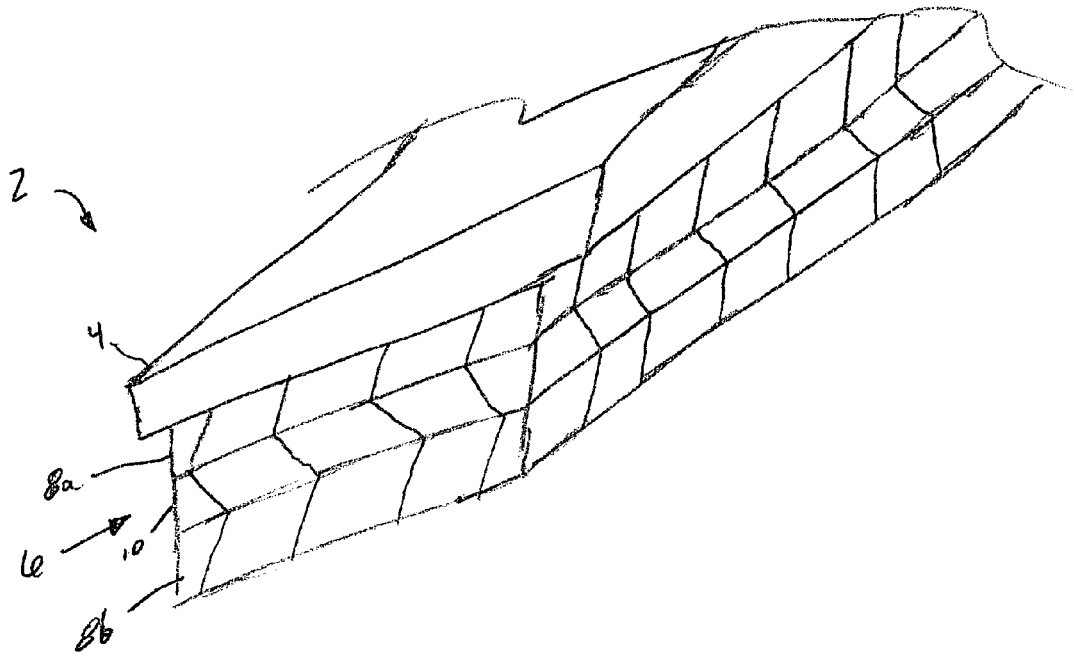
2
4
8a
6
10
8b

NON-EXPLOSIVE ENERGETIC MATERIAL AND A REACTIVE ARMOR ELEMENT USING SAME

This is a Divisional Patent Application of U.S. patent application Ser. No. 11/105,354 filed Apr. 14, 2005 which claims priority to Israel Patent Application No. 161586, filed Apr. 22, 2004, the entire contents of which are hereby incorporated by reference in their entirety.

FIELD OF THE INVENTION

The present invention is concerned with elements for making a protective reactive armor to be fitted on the outside of an enclosure liable to be exposed to attack by shaped-charge warheads and other threats, such as kinetic energy projectiles and fragments, to thereby enhance survivability of the enclosure and its contents. The invention is further concerned with a non-explosive energetic material useful for such reactive armor elements.

Examples of enclosures protectable by a reactive armor element made of elements according to the invention are land vehicles such as battle tanks, armored personnel carriers, armored fighting vehicles, helicopters, armored self-propelled guns; armored static structures such as buildings, above-ground portions of bunkers, container tanks for the storage of fuel and chemicals; etc.

BACKGROUND OF THE INVENTION

Warheads with shaped-charge munitions, also known as hollow charge munition, are known to pierce armors and thereby destroy the protected object from within and, its contents. This capacity of a shaped-charge results from the fact that upon detonation there forms an energy-rich jet also known as "thorn" or "spike" which advances at very high speed of several thousands of meters per second and is thereby capable of piercing even relatively thick armor walls.

Several arrangements have become available in recent years to afford protection against the penetrating effect of an exploding shaped charge, wherein a structure holding at least one reactive armor element, wherein reactive armor element comprises an array of layers comprising one or more plate layers and at least one layer of explosive or any other energetic material ('energetic material'—a material releasing energy during activation/excitement), tightly bearing against at least one of the plate layers. The plate layers are made, for example, of metal or a composite material.

A basic reactive armor element comprises two metal plates sandwiching between them the layer of energetic material. Such prior art reactive armor elements are based on the mass and energy consuming effects of moving plates and their functioning is conditional on the existence of an acute angle between the jet of an oncoming hollow charge threat and the armor itself.

In general, a reactive armor element is a multi-layer body in which each layer tightly bears against each contiguous layer, wherein the multi-layer body includes an outer cover plate, at least one layer of energetic material, at least one intermediary inert body juxtaposed to each of the at least one energetic material layer. Upon activation/excitement of the energetic material (e.g. upon striking by shaped-charge warhead) the jet energizes the armor, where a vast energy discharge occurs so that within microseconds the discharged gases accelerate the metal plates and displaces them away from one another thus disrupting/defeating the jet, thereby loosing its energy to penetrate the protected enclosure.

Whilst efficiency and survivability of the armor are important, the overall performance of an armor is determined by comparing its efficiency versus its survivability. One criteria of an armor, having significant importance, is the ratio of weight per area unit of the armor element. Another criterion of importance is sensitivity of the energetic material. Whilst sensitivity may be an advantage for improving efficiency of the armor, it may reduce survivability of the armor and it may be problematic as far as complying with various transportation requirements.

There are known four principal groups of intermediate materials for armors, disclosed hereinafter in order of their energetic catachrestic:

A. Explosive Reactive Armor (ERA)

Explosive Reactive Armor is the most effective technology to defeat hollow charges, kinetic projectiles, small arms, shrapnel etc. Advanced ERA concepts are considered leap-ahead technology against emerging anti-armor threats. The major challenges of applying ERA to ground combat vehicles are the use of an explosive material as an intermediate layer of the sandwich element, reducing survivability of the armor.

B. Self-Limiting Explosive Reactive Armor (SLERA)

Self-Limiting ERA provides reasonable performance, substantially better than NERA (see below), though less than ERA, with reduced effects on vehicle structures, as compared to ERA. The energetic material layer in SLERA has the potential of being classified as a passive material (NATO specification). SLERA can provide good multiple-hit capability in modular configuration. Thus, while the energetic material used in SLERA is not as effective as fully detonable explosives, this type of reactive armor may provide a more practical option than ERA owing to its survivability characteristics.

C. Non-Explosive Reactive Armor (NxRA)

Non-Explosive Reactive Armor provides a comparable efficiency to SLERA, comparable survivability to NERA (see below), and excellent multiple-hit capability against hollow charge warheads. NxRA's advantages over other reactive armor technologies are that it is totally passive and has substantially better efficiency than NERA. Energetic materials for NxRA are disclosed for example in DE 3132008C1 and in U.S. Pat. No. 4,881,448.

D. Non-Energetic Reactive Armor (NERA)

Non-Energetic Reactive Armor has limited efficiency against hollow charges. NERA's advantage is that it is totally passive and thus provides excellent survivability and maximal multiple-hit capability, comparable to NxRA.

It is an object of the present invention to provide a non-explosive energetic material suitable for NxRA which does not contain explosive material and fulfills its protective function (high efficiency and high survivability of the armor), whilst the non-explosive energetic material lowers the requirements of transportation and logistics according to various standards e.g. UN regulations as appearing in the Recommendations on the Transport of Dangerous Goods.

It is a further object of the present invention to provide an armor element fitted for such an energetic material and where the armor is of comparable efficiency to SLERA and of comparable survivability to NERA.

SUMMARY OF THE INVENTION

The above and other objects are achieved by using a non-explosive energetic material being a gas generator, comprising oxidizers and fuels, whereby exciting the material upon striking by a jet of a hollow charge results in vast generation of gas which accelerates/bulges the armor plates of the reactive armor. This, however, requires that the gas be discharged rapidly, i.e. not more than within a few μsec (microseconds), to thereby ensure disruption/defeating of the jet, and to minimize the penetration into the protected environment.

Thus, is one aspect of the present invention, there is provided a reactive armor element for protection against various types of threats, comprising a casing fitted with an outer cover plate, and at least one sandwich element extending behind the plate; said sandwich element comprising at least one pair of substantially flat plates with an energetic material applied there between, wherein said energetic material is a non-explosive material comprising an oxidizer and a fuel agent, which together with a suitable catalyst material and a binder provide the resultant non-explosive energetic material, constitute a gas generator.

In one embodiment, the oxidizer is an oxidizing agent selected from a nitrate, nitrite, chromate, dichromate, perchlorate, chlorate or a combination thereof. Preferably, the oxidizing agent is a nitrate, most preferably sodium nitrate ($NaNO_3$).

In another embodiment, the catalytic material is a transition metal oxide selected from period 4 (of the periodic table of the elements) oxides such as iron oxides, manganese oxides, zinc oxides, cobalt oxides, and others, or combinations thereof. Preferably, the catalytic material is an iron oxide, most preferably is $Fe_2O_3$.

In yet another embodiment of the present invention, the energetic material comprises a binder serving as a fuel. In one case, said binder is a silicone binder. The energetic material may comprise hollow microballoons for increasing reaction rate thereof. Preferably, said microballoons have each a diameter of about 40 μm. Such microballoons may be made of a material selected from the group of materials comprising, among others, glass, plastic material, metallic and ceramic materials.

In a further embodiment, the energetic material is in the form of a flexible and pliable sheet of material. Preferably, it is a non-class 1 (non-explosive) material and which has uniform thickness and density.

The plates are preferably made of inert material such as metal or ceramics or composite material.

In another specific embodiment, the reactive armor element which may or may not be an add-on armor type, comprises a plurality of sandwich elements disposed within the casing. The cover plate of the casing constitutes a front plate of the at least one sandwich element.

In another one of its aspects, the present invention provides a sandwich element for a reactive armor, comprising at least one pair of substantially flat plates with a non-explosive energetic material applied between said at least one pair of plates, wherein said energetic material is a non-explosive material comprising an oxidizer and a fuel agent, which together with a catalyst material and a binder provide the resultant non-explosive energetic material, constituting a gas generator.

In yet another aspect, the invention provides an energetic material for a reactive armor, characterized in that said material is a non-explosive energetic material comprising an oxidizer and a fuel agent, which together with a catalyst material and a binder provide the resultant non-explosive energetic material, constituting a gas generator.

In still another aspect, there is provided a method of protecting an enclosure against various types of threats, comprising the step of:

fitting the enclosure on an outside with a reactive armor element comprising a casing fitted with an outer cover plate, and at least one sandwich element extending behind the plate; said sandwich element comprising at least one pair of substantially flat plates with energetic material applied between said at least one pair, said energetic material is a non-explosive material comprising an oxidizer and a fuel agent, which together with a suitable catalyst material and a binder provide the resultant non-explosive energetic material, constitute a gas generator.

BRIEF DESCRIPTION OF THE DRAWING

The FIGURE shows an embodiment of the reactive armor element of the present application.

DETAILED DESCRIPTION OF THE INVENTION

For the purpose of the present invention, a group of oxidizers and a group of fuels are selected, which together with suitable catalyst/s and binder/s provide the resultant non-explosive energetic material to constitute a gas generator.

The term "oxidizer" as used herein or any lingual variation thereof refers to a chemical agent having the capacity of increasing the oxygen content of the compound or agent or combinations thereof to be oxidized. According to one particular embodiment, the non-explosive energetic material comprises an oxidizer selected from, among others, nitrates, nitrites, chromates, dichromates, perchlorates, chlorates, etc. and fuels of any type of carbon containing material, and a suitable binder which may also serve as a fuel. According to one particular embodiment, the non-explosive energetic material comprises sodium nitrate ($NaNO_3$) as an oxidizer and a silicone binder as a fuel. It is also possible to combine several types of oxidizers and fuels so as to improve performance of the energetic material in the reactive armor element.

An example for a catalyst material suitable for use with the non-explosive energetic material in accordance with the present invention is a transition metal oxide, specifically period 4 metal (of the periodic table of the elements) oxides which is usually used as a catalyst in energetic materials based on combinations of oxidizers and fuels. Such catalyst material may be selected for example from iron oxides, manganese oxides, zinc oxides, cobalt oxides, and others, or combinations thereof. Preferably, the catalytic material is an iron oxide, most preferably is $Fe_2O_3$.

In order to increase the reaction rate of the non-explosive energetic material, microballoons (i.e. hollow sphere elements) may be added to the formulation. It is appreciated that the microballoons increase the reaction rate upon striking of the armor by a jet of a hollow charge.

Accordingly, such a composition may be considered as a non-explosive material, i.e. a non-class 1 material, as per definitions of the UN Regulations and the US Department of Transportation (DOT).

The non-explosive energetic material according to the present invention may be a flexible sheet of material, pliable and it is easily cut, pierced, etc. whereby it is conveniently applied between the bearing plates of the armor element.

According to one particular embodiment the material is rubber-like and is easily foldable.

According to the present invention there is provided a NxRA element with a non-explosive energetic material of the above type for protection against shaped-charge warheads, as well as against small arms, shrapnel, fragments and various types of kinetic projectiles, e.g. Armor Piercing Fin Stabilized Discarded Sabot (APFSDS).

The NxRA element comprises a module fitted with an outer cover plate and at least one sandwich element within the module. Said sandwich element comprising at least one pair of substantially flat inert plates with a non-explosive energetic material as disclosed herein above applied there between.

According to some embodiments, there may be several pairs of inert plates, e.g. made of metals (such as steel, aluminum, and titanium), ceramics, composite materials and others, where the non-explosive energetic material is applied there between. Furthermore, the cover plate of the casing of the reactive armor, may constitute a front plate (or a top/bottom plate) of the at least one sandwich element.

A reactive armor according to the present invention may be of any shape and size as known in the art, suited for applying to different enclosures, and may be of various configurations.

A reactive element according to the invention (NxRA) is efficient against shaped charge war-heads, giving as an example RPG7, as well as against various types of kinetic projectiles, e.g. APFSDS, small arms (e.g. 14.5 mm), shrapnel and fragments. A NxRA element according to the present invention provides comparable efficiency to SLERA as discussed hereinabove, as well as comparable survivability to NERA. The NxRA element is advantageous over other reactive armor technologies as it is totally passive, as NERA, and it offers improved survivability to the protected enclosure, to neighboring reactive elements and further provides excellent multiple-hit capability against hollow-charge warheads, small arms and kinetic projectiles and eliminates fragmentation hazards.

According to the present invention there is provided a non-explosive energetic material being a gas generator, comprising oxidizers and fuels, whereby exciting the material upon striking by a jet of a hollow charge results in vast generation of gas which accelerates/bulges the armor plates of the reactive armor. This however requires that the gas be discharged rapidly, i.e. not more than a few μsec (microseconds), to thereby ensure disruption/defeating of the jet, and to minimize the penetration into a protected environment.

For that purpose, a group of oxidizers is selected and a group of fuels, which together with suitable catalyst/s and binder/s provide the resultant non-explosive energetic material to constitute a gas generator.

According to one particular embodiment, the non-explosive energetic material comprises an oxidizer selected from the group of families comprising, among others, nitrates (salts or esters of nitric acid), nitrites (compounds containing nitrite radicals, said compounds being either organic or inorganic in nature), chromates (salts or esters of chromic acid), dichromates (salts or esters of dichromic acid), perchlorates (salts of perchloric acid), chlorates (salts derived from chloric acid), etc. and fuels of any type of carbon containing material, and a binder which may also serve as a fuel.

According to one particular embodiment, the non-explosive energetic material comprises sodium nitrate ($NaNO_3$) as an oxidizer and a silicone binder as a fuel. It is also possible to combine several types of oxidizers and fuels so as to improve performance of the energetic material in the reactive armor element.

In order to increase the reaction rate of the non-explosive energetic material, microballoons (i.e. hollow spherical elements) may be added to the formulation. It is appreciated that the microballoons increase the reaction rate upon striking of the armor by a jet of a hollow charge. Such spherical elements may be made for example of glass, plastic material, metallic or ceramic materials. The diameter of such spheres may be about 40 μm, though other dimensions may be also suitable.

The non-explosive energetic material according to the present invention is a flexible sheet of material, pliable and it is easily cut, pierced, etc. whereby it is conveniently applied between the bearing plates of the armor element. According to one particular embodiment the material is rubber-like and is easily foldable.

The energetic material qualifies as a non-class 1 material as defined by UN Regulations and the US Department of Transportation (DOT), and is thus a non-explosive energetic material.

The non-explosive energetic material is suitable for manufacturing an NxRA element for protection of enclosures against shaped-charge warheads, small arms, shrapnel, fragments and kinetic projectiles. With respect to the FIGURE, such a reactive armor element 2 comprises a casing attached to the enclosure and fitted with an outer cover plate 4 and at least one sandwich element 6 extending behind the plate; said sandwich element comprising at least one pair of substantially flat plates 8*a* and 8*b* with the non-explosive energetic material 10 applied there between.

In one example, the energetic material comprises:

Oxidizer—up to about 80%;

Fuel—up to about 50%;

Catalyst—up to about 2%; and

Microballoons—up to about 10%.

In one specific example, the energetic material of the present invention comprises:

Oxidizer—from about 30 to about 80% (such as sodium nitrate);

Fuel—from about 25 to 50% (such as a silicon binder);

Catalyst—from about 0% to about 2% (such as ferric oxide); and

Microballoons—from about 0% to about 10%.

It is appreciated that the above descriptions are intended only to serve as examples and that many other embodiments are possible, all of which fall within the spirit and the scope of the present invention.

The invention claimed is:

1. A method of protecting an enclosure against various types of threats, comprising the step of:

fitting the enclosure on an outside with a reactive armor element comprising a casing fitted with an outer cover plate, and at least one sandwich element extending behind the plate; said sandwich element comprising at least one pair of substantially fiat plates with energetic material applied between said at least one pair, said energetic material is a non-explosive, non-class I material in the form of a flexible and pliable sheet, and comprising an oxidizer and a fuel agent, which together with a suitable catalyst material and a silicone binder provide the resultant non-explosive energetic material, constitute a few microsecond duration gas generator.

2. A method according to claim 1, wherein the oxidizer is selected from a group of families comprising nitrates, nitrites chromates, dichromates, perchiorates and chiorates.

3. A method according to claim 1, wherein the energetic material comprises sodium nitrate ($NaNO_3$) as an oxidizer.

4. A method according to claim 1, wherein the amount of said oxidizer does not exceed about 80%.

5. A method according to claim 1, wherein the catalytic material is a transition metal oxide.

6. A method according to claim 5, wherein the catalyst material is $Fe_2O_3$.

7. A method according to claim 1, wherein the amount of said catalytic material does not exceed about 2%.

8. A method according to claim 1, wherein the energetic material comprises a binder serving as a fuel.

9. A method according to claim 8, wherein the amount of said fuel does not exceed about 50%.

10. A method according to claim 1, wherein the energetic material comprises hollow micro-balloons.

11. A method according to claim 10, wherein the hollow micro-balloons have a diameter of about 40 μm.

12. A method according to claim 10, wherein the hollow micro-balloons are made of a material selected from the group of materials comprising glass, plastic material, metallic and ceramic materials.

13. A method according to claim 10, wherein the amount of said micro-balloons does not exceed about 10%.

14. A method according to claim 1, wherein the energetic material has uniform thickness and density.

* * * * *